United States Patent [19]

Awbrey

[11] Patent Number: 4,952,301

[45] Date of Patent: Aug. 28, 1990

[54] METHOD OF INHIBITING FOULING IN CAUSTIC SCRUBBER SYSTEMS

[75] Inventor: Spencer S. Awbrey, Spring, Tex.

[73] Assignee: Betz Laboratories, Inc., Trevose, Pa.

[21] Appl. No.: 432,699

[22] Filed: Nov. 6, 1989

[51] Int. Cl.[5] ..... C10G 19/00

[52] U.S. Cl. ..... 208/48 AA; 208/48 R; 208/289; 585/2; 585/950

[58] Field of Search ..... 585/860, 950, 2; 208/48 AA, 289

[56] References Cited

U.S. PATENT DOCUMENTS

| | | | |
|---|---|---|---|
| 3,173,770 | 3/1965 | Thompson et al. | 208/48 AA |
| 3,698,926 | 10/1972 | Furuichi | 117/17.5 |
| 3,756,943 | 9/1973 | Hopkins et al. | 208/48 AA |
| 3,793,187 | 2/1974 | Marx et al. | 208/48 AA |
| 3,907,423 | 9/1975 | Hayashi et al. | 355/10 |
| 4,021,586 | 5/1977 | Matkan | 427/17 |
| 4,052,959 | 10/1977 | Hayashi et al. | 118/644 |
| 4,177,730 | 12/1979 | Schriber et al. | 101/248 |
| 4,220,699 | 9/1980 | Ishida et al. | 430/126 |
| 4,286,039 | 8/1981 | Landa et al. | 430/119 |
| 4,310,238 | 1/1982 | Mochizuki et al. | 355/14 |
| 4,325,627 | 4/1982 | Swidler et al. | 355/10 |
| 4,455,562 | 6/1984 | Dolan et al. | 346/154 |
| 4,515,292 | 5/1985 | Koos, Jr. | 222/52 |
| 4,563,086 | 1/1986 | Knapp et al. | 355/14 |
| 4,601,259 | 7/1986 | Yamashita | 118/658 |
| 4,673,489 | 6/1987 | Roling | 208/289 |
| 4,734,737 | 3/1988 | Koichi | 355/14 |
| 4,760,423 | 7/1988 | Holtje et al. | 355/3 |
| 4,827,315 | 5/1989 | Wolfberg et al. | 346/160 |
| 4,828,956 | 5/1989 | Creatura et al. | 430/137 |
| 4,829,336 | 5/1989 | Champion et al. | 355/246 |
| 4,860,924 | 8/1989 | Simms et al. | 222/56 |

*Primary Examiner*—Helane Myers

*Attorney, Agent, or Firm*—Alexander D. Ricci; Bruce E. Peacock

[57] ABSTRACT

A method for inhibiting the formation of polymeric based fouling deposits normally formed during the caustic washing of hydrocarbons is disclosed. The method comprises adding an effective amount for the purpose of an ethylenediamine compound (e.g., ethylenediamine, diethylenetriamine, etc.) to the caustic wash system.

27 Claims, No Drawings

METHOD OF INHIBITING FOULING IN CAUSTIC SCRUBBER SYSTEMS

FIELD OF THE INVENTION

The present invention pertains to methods for inhibiting the formation of fouling deposits in basic (i.e., pH>7) wash systems of the type adapted to scrub impurities from liquid or gas phase hydrocarbonaceous mediums.

BACKGROUND OF THE INVENTION

This invention relates to the prevention of fouling in a basic solution which is in contact with a gaseous or liquid hydrocarbon stream.

In cracking operations, such as in the pyrolytic cracking of ethane, propane, and naphthas to form olefins, oxygenated compounds, including carbonyl compounds, are formed. The amount of carbonyl compounds, such as aldehydes and ketones, formed in such operations can vary widely, but is typically about 1-100 ppm in the gas stream with concentrations as high as 1000 ppm occasionally being encountered because of the utilization of various feedstocks and cracking temperatures. When the gas stream is passed through a basic wash (pH>7) to remove acidic components such as hydrogen sulfide and carbon dioxide, oxygen containing compounds, such as the carbonyl functionality compounds, are also removed. These oxygen containing compounds, particularly acetaldehyde, will undergo polymerization in the presence of the basic wash or scrubbing conditions. In the wash tower, the resulting polymer will settle on the trays leading to fouling and eventual plugging of the trays, which means the unit must be shut down for cleaning — obviously a costly operation. The basic wash systems, where treatment is required to inhibit such polymer-based fouling, include amine acid gas scrubber (e.g., MEA, DEA, isopropyl amine, butyl amine, etc.) and caustic wash systems.

SUMMARY OF THE INVENTION

Polymer based fouling is inhibited in basic (pH 7) wash systems of the type adapted to remove impurities from liquid or gas phase hydrocarbon mediums by adding to the wash system an ethylenediamine compound. As used herein, "ethylenediamine compound" signifies any compound within the class defined by the formula $$NH_2(CH_2CH_2NH)_xH$$

wherein x is an integer of from 1 to about 10. Also within the purview of "ethylenediamine compound" are the water soluble salt forms of the amines encompassed by the above formula.

The treatment is particularly well suited for inhibition of polymer based deposits formed during the caustic scrubbing of gas phase olefinic hydrocarbons resulting from pyrolytic cracking processes. Heretofore, when such gas phase olefinic hydrocarbon streams were subjected to caustic wash systems, the carbonyl compounds therein, including ketone and aldehyde contaminants, tended to undergo Aldol condensation, forming insoluble polymer molecules. The polymers deposited on system equipment and, for instance, tended to plug the trays in the caustic wash tower.

Between the aldehyde and ketone type contaminants, aldehyde based polymer formation appears to be more prevalent and more troublesome. In fact, between ketone and aldehyde contaminants, it is desirable to provide an antifoulant treatment that exhibits selectivity for the aldehyde. Such selectivity appears to be exhibited by the ethylenediamine compound treatment of the present invention.

The inventive method is particularly appropriate for the basic washing process which follows the pyrolytic cracking of such hydrocarbons as ethane, propane, butane, naphtha and mixtures thereof to produce the corresponding gaseous ethylene, propylene, butadiene and the like, containing the carbonyl and other contaminants.

Generally, the basic washing entails contacting the gaseous olefins with an aqueous basic solution in a wash tower to remove hydrogen sulfide, carbon dioxide and other oxygenated compounds therefrom. As earlier discussed, the conditions are such as to be conducive for condensation reactions of any aldehydes (acetaldehydes) and/or ketones contained therein.

The present method entails assuring that the basic wash takes place in the presence of the ethylenediamine compounds.

PRIOR ART

In U.S. Pat. No. 4,673,489 (Roling), hydroxylamine and its hydrochloride and hydrogen sulfate salts have been used to inhibit polymer formation caused by condensation reaction of aldehydes contained in caustic scrubber units. However, despite the tremendous success of such treatments, these compounds are expensive and must be overfed to the caustic scrubber units in light of their apparent selectivity toward the ketone contaminant.

To my knowledge, ethylenediamines have neither been used or proposed for use to inhibit carbonyl based fouling, particularly aldehyde fouling, that often occurs during caustic scrubbing of liquid or gas phase hydrocarbon streams. The ethylenediamine compounds are stable in caustic, tend to be selective in reacting with the troublesome aldehyde type contaminants, and provide an economical treatment approach.

DETAILED DESCRIPTION OF THE PREFERRED EMBODIMENT

In accordance with the invention, ethylenediamine (E.D.A.) compounds of the class $$NH_2(CH_2CH_2NH)_xH$$

x=1 to about 10 and water soluble salt forms thereof, are added to the aqueous medium of a basic (i.e., pH>7) wash or scrubber system. Of these compounds, ethylenediamine itself is preferred. In addition, exemplary compounds include:

diethylenetriamine
triethylenetetramine
tetraethylenepentamine; and
pentaethylenehexamine These fouling inhibitors can be added to the caustic tower as neat materials or in solution form. The preferred method of addition is as an aqueous solution with 2 to 50 weight percent inhibitor present, so that accurate metering of the inhibitor to the tower can be achieved.

Although applicant is not to be bound to any particular theory of operation, it is thought that the E.D.A. compounds form a complex with the aldehyde-type contaminants and that the resulting complex does not undergo polymerization. One possible reaction in accordance with the theory is as follows:

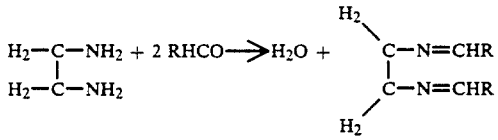

Similar reactions are postulated for the other ethylenediamine compounds encompassed by the above formula.

In accord with the above, 1 mole of E.D.A. compound is needed for every two moles of aldehyde. amount of from about 0.5–10 moles per mole of aldehyde. Preferably, the feed rate ranges from 1.0–3 moles of E.D.A. compound per mole of aldehyde, with a 1:1 mole ratio being especially preferred.

The treatment should be added to the wash in sufficient quantity to assure that the molar amount of E.D.A. is sufficient to react with all of the undesirable carbonyl contaminants. Treatment ranges of from about 1 to 10,000 ppm of E.D.A. per one million parts of the aqueous scrubbing medium may also be mentioned if no convenient method of measuring carbonyl content is available.

The treatment is especially well adapted to inhibit polymer based fouling in caustic wash systems wherein gaseous olefinic compounds are washed. These gas phase olefins comprise ethylene, propylene, butadiene, etc., which are formed from the pyrolytic cracking of hydrocarbon feedstocks such as ethane, propane, butane, naphtha, or mixtures thereof. The invention may be utilized in any alkaline wash system but is particularly useful in caustic washes such as sodium hydroxide, potassium hydroxide, and in some of the organic caustic materials.

The invention will be further illustrated by the following examples which are intended merely for purpose of illustration and are not to be regarded as limiting the scope of the invention or the manner in which it may be practiced.

EXAMPLES

EXAMPLE 1

Two graduated cylinders were each filled with 15 ml of 7N NaOH solution. 0.5 ml of ethylenediamine (E.D.A.) was added to one cylinder with 0.5 ml of water being added to the other cylinder as a control. 1 ml of acetaldehyde was added to both cylinders. A yellow color developed quickly in the control with polymer formation being visible within about 20 minutes. In contrast, the E.D.A. treated solution remained clear with a layer of water insoluble (yet dispersible) reaction products floating on the top. No polymer formation was observed for the E.D.A. treated solution. The E.D.A. treated solution was then heated to reflux temperature with no polymer formation being indicated after two hours at this high temperature.

EXAMPLES 2–5

Results similar to the E.D.A. treated run of Example 1 are to be expected if the procedure of example 1 is used to test the following compounds:

Example 2—diethylenetriamine

Example 3—triethylenetetramine

Example 4—tetraethylenepentamine

Example 5—pentaethylenehexamine

While this invention has been described with respect to particular embodiments thereof, it is apparent that numerous other forms and modifications of this invention will be obvious to those skilled in the art. The appended claims and this invention generally should be construed to cover all such obvious forms and modifications that are within the true spirit and scope of the present invention.

I claim:

1. A method for inhibiting the formation of polymeric based fouling deposits which, in the absence of inhibition treatment, are formed during the basic washing of hydrocarbons contaminated with oxygen-containing compounds, said method comprising adding to the wash an inhibiting amount of an ethylenediamine compound of the formula $$NH_2(CH_2CH_2NH)_xH$$

wherein x is an integer of from 1 to about 10.

2. A method as recited in claim 1 wherein said ethylenediamine compound is ethylenediamine.

3. A method as recited in claim 1 wherein said ethylenediamine compound is diethylenetriamine.

4. A method as recited in claim 1 wherein said ethylenediamine compound is triethylenetetramine.

5. A method as recited in claim 1 wherein said ethylenediamine compound is tetraethylenepentamine.

6. A method as recited in claim 1 wherein said ethylenediamine compound is pentaethylenehexamine.

7. A method as recited in claim 1 wherein the hydrocarbon being washed is produced by the pyrolytic cracking of hydrocarbon feedstocks.

8. A method as recited in claim 7 wherein said hydrocarbon feedstocks are selected from the group consisting of ethane, propane, butane, naphtha and mixtures thereof.

9. A method as recited in claim 1 wherein the hydrocarbon being washed comprises an olefin contaminated with oxygen-containing compound impurities.

10. A method as recited in claim 1 wherein the hydrocarbon being washed is in the gaseous phase.

11. A method as recited in claim 9 wherein said oxygen-containing compound impurities are composed primarily of carbonyl compounds.

12. A method as recited in claim 11 wherein said carbonyl compounds comprise aldehydes, ketones or mixtures thereof.

13. A method as recited in claim 11 wherein said ethylenediamine compound is added to said basic wash in an amount representing a molar ratio of said ethylenediamine compound to said carbonyl compounds of from about 0.5:1 to about 10:1.

14. A method as recited in claim 13 wherein said molar ratio is about 1:1.

15. A method as recited in claim 13 wherein said molar ratio is from about 1:1 to about 3:1.

16. A method of inhibiting the formation and deposition of fouling materials on the structural parts of a basic wash system during the basic wash of a pyrolytically produced olefinic compound or compounds contaminated with at least one carbonyl compound, said method comprising adding to said wash an inhibiting amount of an ethylenediamine compound of the formula $NH_2(CH_2CH_2NH)_xH$ wherein x is an integer of from 1 to about 10.

17. A method as recited in claim 16 wherein said ethylenediamine compound is ethylenediamine.

18. A method as recited in claim 16 wherein said ethylenediamine compound is diethylenetriamine.

19. A method as recited in claim 16 wherein said ethylenediamine compound is triethylenetetramine.

20. A method as recited in claim 16 wherein said ethylenediamine compound is tetraethylenepentamine.

21. A method as recited in claim 16 wherein said ethylenediamine compound is pentaethylenehexamine.

22. A method as recited in claim 16 wherein said carbonyl compounds comprise aldehydes or ketones and mixtures thereof.

23. A method as recited in claim 16 wherein said ethylenediamine compound is added to said basic wash in an amount representing a molar ratio of said ethylenediamine compound to said carbonyl compound of from about 0.5:1 to about 10:1.

24. A method as recited in claim 16 wherein said ethylenediamine compound is added in a molar ratio of from about 1:1 to about 3:1.

25. A method as recited in claim 16 wherein said ethylenediamine compound is added in a molar ratio of about 1:1.

26. A method as recited in claim 14 wherein said olefin comprises a member selected from the group consisting of ethylene, propylene, butadiene and mixtures thereof.

27. A method as recited in claim 26 wherein said olefin is in gas phase.

* * * * *